US012104599B2

(12) United States Patent
Morita et al.

(10) Patent No.: US 12,104,599 B2
(45) Date of Patent: Oct. 1, 2024

(54) LIQUID FEED TYPE GAS COMPRESSOR HAVING A LIQUID SUPPLY SYSTEM WITH FIRST AND SECOND COOLING UNITS

(71) Applicant: HITACHI INDUSTRIAL EQUIPMENT SYSTEMS CO., LTD., Tokyo (JP)

(72) Inventors: Kenji Morita, Tokyo (JP); Shigeyuki Yorikane, Tokyo (JP); Yuta Kajie, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 18/024,804

(22) PCT Filed: Sep. 14, 2021

(86) PCT No.: PCT/JP2021/033784
§ 371 (c)(1),
(2) Date: Mar. 6, 2023

(87) PCT Pub. No.: WO2022/059680
PCT Pub. Date: Mar. 24, 2022

(65) Prior Publication Data

US 2023/0332602 A1 Oct. 19, 2023

(30) Foreign Application Priority Data

Sep. 18, 2020 (JP) ..... 2020-157002

(51) Int. Cl.
*F04C 29/02* (2006.01)
*F04C 18/16* (2006.01)
*F04C 29/04* (2006.01)

(52) U.S. Cl.
CPC ..... *F04C 29/026* (2013.01); *F04C 18/16* (2013.01); *F04C 29/02* (2013.01); *F04C 29/021* (2013.01); *F04C 29/04* (2013.01); *F04C 29/042* (2013.01)

(58) Field of Classification Search
CPC ..... F04C 15/0088; F04C 15/0092; F04C 29/02–028
See application file for complete search history.

(56) References Cited

U.S. PATENT DOCUMENTS 4,394,113 A * 7/1983 Bammert ..... F04C 27/009 418/98
5,653,585 A * 8/1997 Fresco ..... F25B 1/047 418/94
2012/0090340 A1* 4/2012 Okamoto ..... F04C 29/04 62/238.2

(Continued)

FOREIGN PATENT DOCUMENTS

BE 1014461 A3 * 10/2003 ..... F04C 23/001
BE 1017320 A3 * 6/2008 ..... F04C 18/16

(Continued)

OTHER PUBLICATIONS

International Search Report of PCT/JP2021/033784 dated Nov. 2, 2021.

(Continued)

*Primary Examiner* — Laert Dounis
(74) *Attorney, Agent, or Firm* — MATTINGLY & MALUR, PC

(57) ABSTRACT

An oil feed type air compressor includes a compressor main body, a separator that separates the oil from the compressed air delivered from the compressor main body, and an oil feed system that supplies the oil to the working chambers and bearings of the compressor main body. The oil feed system includes an oil cooler that includes a cooling unit and a cooling unit connected on a downstream side of the cooling unit, an oil feed pipe that is connected to an outlet between (Continued)

the cooling unit and the cooling unit and that supplies the oil cooled by the cooling unit to the bearings of the compressor main body, and an oil feed pipe that is connected to an outlet on a downstream side of the cooling unit and that supplies the oil cooled by the cooling units to the working chambers of the compressor main body.

5 Claims, 6 Drawing Sheets

(56) References Cited

U.S. PATENT DOCUMENTS

| | | | | |
|---|---|---|---|---|
| 2018/0238329 | A1 | 8/2018 | Kasahara et al. | |
| 2019/0024651 | A1 | 1/2019 | Kotani et al. | |
| 2019/0063438 | A1* | 2/2019 | Hamada | F04C 29/04 |
| 2019/0072093 | A1* | 3/2019 | Tajima | F04C 29/026 |

FOREIGN PATENT DOCUMENTS

| | | | |
|---|---|---|---|
| JP | 10-159764 | A | 6/1998 |
| JP | 2009-144685 | A | 7/2009 |
| JP | 2013-241920 | A | 12/2013 |
| JP | 2018-3720 | A | 1/2018 |
| WO | 2016/136482 | A1 | 9/2016 |
| WO | 2017-110220 | A1 | 6/2017 |
| WO | WO-2021024607 | A1 * | 2/2021 |

OTHER PUBLICATIONS

International Preliminary Report on Patentability received in corresponding International Application No. PCT/JP2021/033784 dated Mar. 30, 2023.

Japanese Office Action received in corresponding Japanese Application No. 2022-550568 dated Oct. 3, 2023.

* cited by examiner

LIQUID FEED TYPE GAS COMPRESSOR HAVING A LIQUID SUPPLY SYSTEM WITH FIRST AND SECOND COOLING UNITS

TECHNICAL FIELD

The present invention relates to a liquid feed type gas compressor.

BACKGROUND ART

Patent Document 1 discloses an oil feed type air compressor as one of liquid feed type gas compressors. This oil feed type air compressor includes a compressor main body, a separator, and an oil feed system (liquid supply system).

The compressor main body includes two screw rotors that mesh with each other, a plurality of bearings that rotatably support the two screw rotors, and a casing that houses the two screw rotors and the plurality of bearings. A plurality of working chambers are formed between each screw rotor and an inner wall of the casing. Air (gas) is compressed while oil (liquid) is injected into the working chambers, for the purpose of sealing the working chambers, cooling compression heat, and lubricating the rotors, for example.

The separator separates the oil from the compressed air (compressed gas) delivered from the compressor main body and stores the oil. The oil feed system supplies the oil stored in the separator to the working chambers and the bearings of the compressor main body. The oil feed system includes an oil cooler (cooler) that cools the oil by heat exchange with cooling air generated by a cooling fan, a bypass pipe that bypasses the oil cooler, and a temperature regulating valve that regulates a flow division ratio of the oil for the oil cooler and a flow division ratio of the oil for the bypass pipe according to the temperature of the oil.

PRIOR ART DOCUMENT

Patent Document

Patent Document 1: JP-2009-144685-A

SUMMARY OF THE INVENTION

Problems to be Solved by the Invention

In the above-described conventional technology, the temperature of the oil supplied from the oil feed system to the working chambers of the compressor main body and the temperature of the oil supplied from the oil feed system to the bearings of the compressor main body are substantially the same.

Here, if the temperature of the oil to be supplied to the working chambers of the compressor main body is lowered, for example, the compression state becomes close to isothermal compression from adiabatic compression, and therefore, compression power is decreased. However, the temperature of the oil to be supplied to the bearings of the compressor main body is also lowered, and the viscosity of the oil is thus increased. Accordingly, a mechanical loss is increased. As described above, although the compression power is decreased, the mechanical loss is increased, so that shaft power of the compressor cannot be reduced sufficiently.

On the other hand, if the temperature of the oil to be supplied to the bearings of the compressor main body is raised, for example, the viscosity of the oil becomes lower, and therefore, the mechanical loss is decreased. However, the temperature of the oil to be supplied to the working chambers of the compressor main body is also raised, and the compression state becomes close to adiabatic compression from isothermal compression, so that the compression power is increased. As described above, although the mechanical loss is decreased, the compression power is increased, so that the shaft power of the compressor cannot be reduced sufficiently.

The present invention has been made in view of the above-described circumstances. It is one of objects of the present invention to reduce shaft power of a compressor.

Means for Solving the Problems

In order to solve the above problems, configurations described in claims are applied thereto. The present invention includes a plurality of pieces of means for solving the above-described problems. As an example of such means, there is provided a liquid feed type gas compressor including a compressor main body that includes a rotor, bearings rotatably supporting the rotor, and a casing housing the rotor and the bearings and that compresses gas while injecting a liquid to working chambers formed between the rotor and an inner wall of the casing, a separator that separates the liquid from compressed gas delivered from the compressor main body, and a liquid supply system that supplies the liquid separated by the separator to the working chambers and the bearings of the compressor main body. The liquid supply system includes a cooler including a first cooling unit that cools the liquid and a second cooling unit that is connected to a downstream side of the first cooling unit and that cools the liquid, a first liquid supply pipe that is connected to an outlet between the first cooling unit and the second cooling unit of the cooler and that supplies the liquid cooled by the first cooling unit of the cooler to the bearings of the compressor main body, and a second liquid supply pipe that is connected to an outlet on a downstream side of the second cooling unit of the cooler and that supplies the liquid cooled by the first cooling unit and the second cooling unit of the cooler to the working chambers of the compressor main body.

Advantages of the Invention

According to the present invention, the shaft power of the compressor can be reduced.

Incidentally, problems, configurations, and effects other than those described above will be made apparent by the following description.

MODE FOR CARRYING OUT THE INVENTION

One embodiment of the present invention will be described with reference to the drawings.

Figure 1:
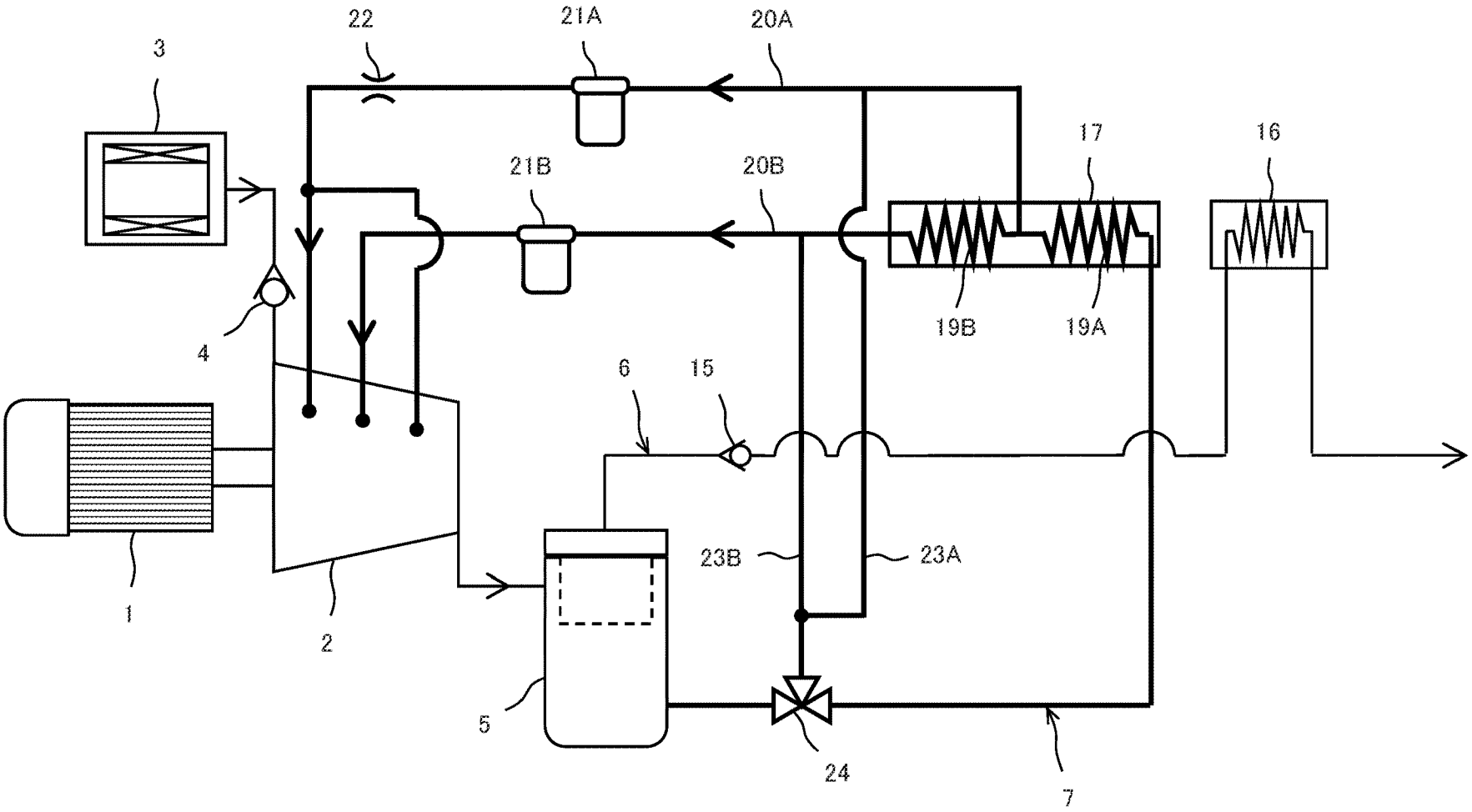
FIG. 1 is a schematic diagram illustrating a configuration of an oil feed type air compressor according to one embodiment of the present invention.
Figure 2:
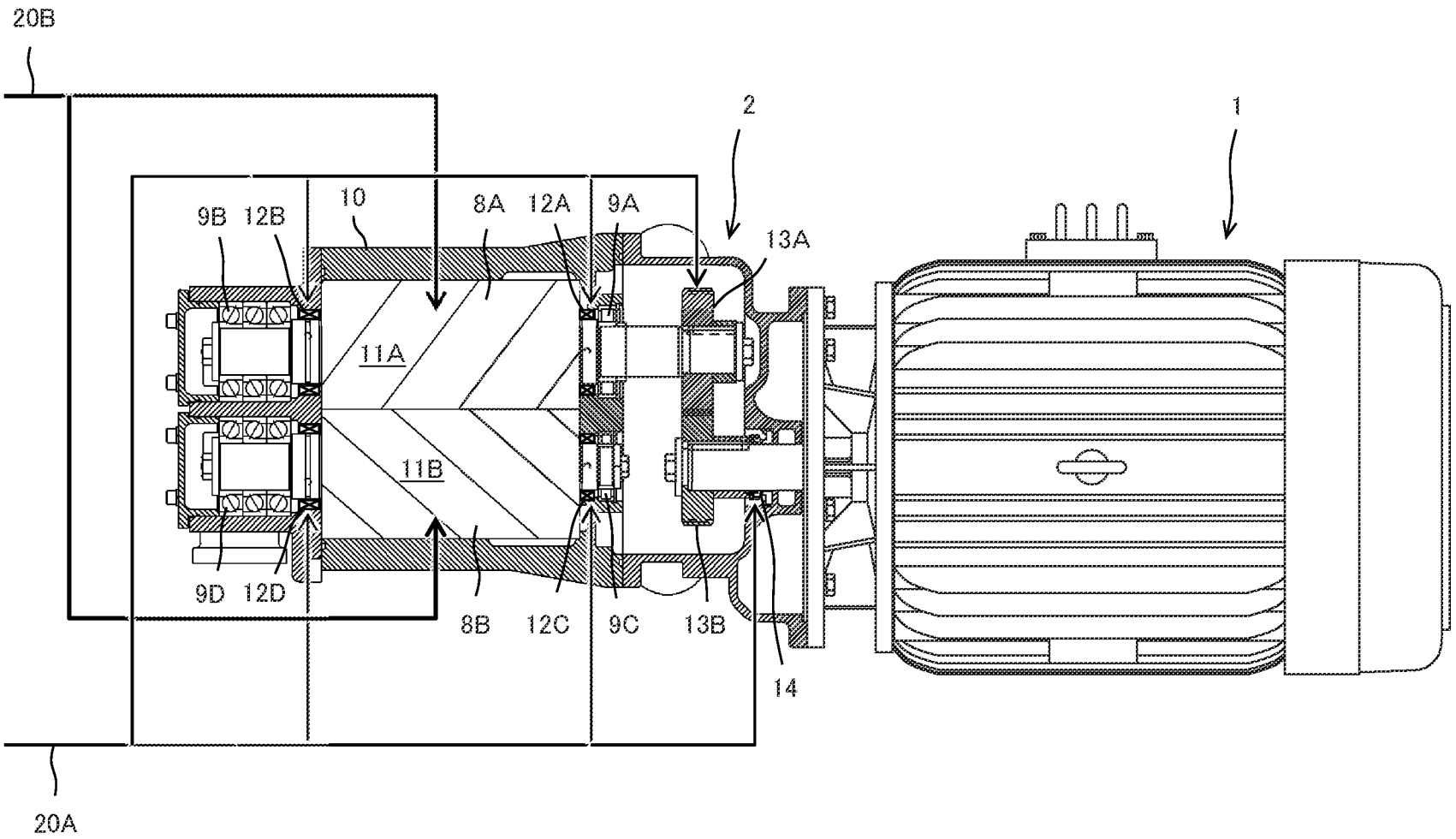
FIG. 2 is a sectional view illustrating a structure of a compressor main body according to the one embodiment of the present invention.
Figure 3:
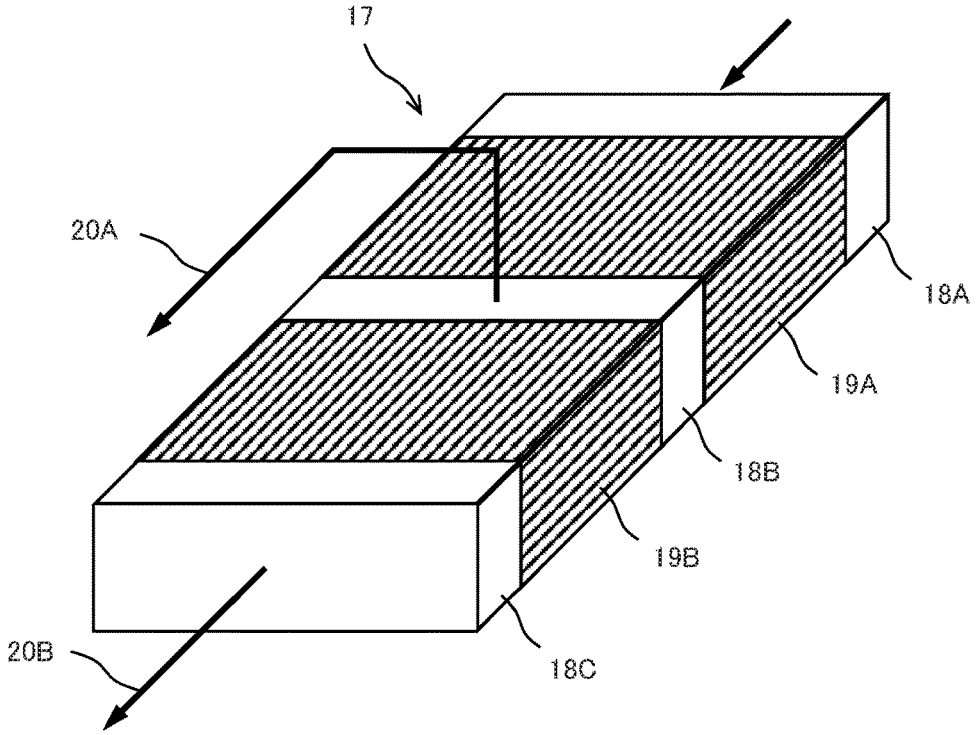
FIG. 3 is a schematic diagram illustrating a structure of an oil cooler according to the one embodiment of the present invention.

FIG. 1 is a schematic diagram illustrating a configuration of an oil feed type air compressor according to the present embodiment. FIG. 2 is a sectional view illustrating a structure of a compressor main body according to the present embodiment. FIG. 3 is a schematic diagram illustrating a structure of an oil cooler according to the present embodiment.

The oil feed type air compressor according to the present embodiment includes a motor 1, a compressor main body 2 driven by the motor 1 to compress air (gas), an air filter 3 and a suction throttle valve 4 that are provided on the suction side of the compressor main body 2, a separator 5 provided on the delivery side of the compressor main body 2, a compressed air system 6 (compressed gas system) connected to an upper portion of the separator 5, and an oil feed system 7 (liquid supply system) connected to a lower portion of the separator 5 and the compressor main body 2.

The compressor main body 2 includes two screw rotors 8A and 8B (specifically a male rotor 8A and a female rotor 8B) that mesh with each other, bearings 9A and 9B that rotatably support the screw rotor 8A, bearings 9C and 9D that rotatably support the screw rotor 8B, and a casing 10 that houses the screw rotors 8A and 8B and the bearings 9A to 9D. A plurality of working chambers 11A are formed between the screw rotor 8A and an inner wall of the casing 10 (in other words, in grooves of the screw rotor 8A). A plurality of working chambers 11B are formed between the screw rotor 8B and the inner wall of the casing 10 (in other words, in grooves of the screw rotor 8B).

A shaft sealing unit 12A is disposed on the outer circumference side of one shaft portion of the screw rotor 8A. A shaft sealing unit 12B is disposed on the outer circumference side of the other shaft portion of the screw rotor 8A. A shaft sealing unit 12C is disposed on the outer circumference side of one shaft portion of the screw rotor 8B. A shaft sealing unit 12D is disposed on the outer circumference side of the other shaft portion of the screw rotor 8B. A gear 13A is provided to the one shaft portion of the screw rotor 8A. A gear 13B is provided to a rotary shaft of the motor 1. The gears 13A and 13B mesh with each other. A shaft sealing unit 14 is disposed on the outer circumference side of the rotary shaft of the motor 1.

A rotational force of the rotary shaft of the motor 1 is transmitted via the gears 13A and 13B to rotate the screw rotor 8A. The screw rotor 8B rotates accordingly. As the screw rotors 8A and 8B rotate, the working chambers 11A and 11B move in the axial direction of the rotors (left direction in FIG. 2), and sequentially perform a suction process, a compression process, and a delivery process. The working chambers suck air via the air filter 3 and the suction throttle valve 4 in the suction process. The working chambers compress the air in the compression process. The working chambers deliver the compressed air (compressed gas) to the separator 5 in the delivery process. The compressor main body 2 allows oil to be injected into the working chambers 11A and 11B for the purpose of sealing the working chambers, cooling compression heat, and lubricating the rotors, for example.

The separator 5 separates the oil from the compressed air delivered from the compressor main body 2 and stores the oil. The compressed air system 6 supplies the compressed air separated by the separator 5 to equipment (not illustrated) on a user side. The compressed air system 6 includes a pressure regulating check valve 15 and an aftercooler 16 disposed on the downstream side of the pressure regulating check valve 15. The aftercooler 16 cools the compressed air by heat exchange with cooling air generated by a cooling fan (not illustrated), for example.

The oil feed system 7 supplies, by the pressure within the separator 5, the oil stored in the separator 5 to the working chambers 11A and 11B, the bearings 9A to 9D, and the shaft sealing units 12A to 12D of the compressor main body 2 as well as the gears 13A and 13B and the shaft sealing unit 14 of the motor 1. The oil feed system 7 includes an oil cooler 17 (cooler) that cools the oil.

The oil cooler 17 includes, for example, a header 18A, a cooling unit 19A, a header 18B, a cooling unit 19B, and a header 18C connected to one another in such a manner that the oil flows in that order. The cooling unit 19A cools the oil flowing in from the header 18A, by heat exchange with cooling air generated by a cooling fan, for example, and discharges the cooled oil to the header 18B. The cooling unit 19B cools the oil flowing in from the header 18B, by heat exchange with cooling air generated by a cooling fan, for example, and discharges the cooled oil to the header 18C. An inlet into which the oil from the separator 5 flows is formed in the header 18A. An outlet from which the oil cooled by the cooling unit 19A is discharged is formed in the header 18B. An outlet from which the oil cooled by the cooling units 19A and 19B is discharged is formed in the header 18C. Incidentally, because the oil is discharged from the outlet of the header 18B, the flow rate of the oil in the cooling unit 19B is lower than the flow rate of the oil in the cooling unit 19A.

The oil feed system 7 further includes an oil feed pipe 20A (liquid supply pipe) connected to the outlet of the header 18B of the oil cooler 17 (in other words, between the cooling unit 19A and the cooling unit 19B), an oil filter 21A that is disposed on the oil feed pipe 20A (in other words, on the downstream side of the oil cooler 17) and that removes impurities in the oil, a restrictor 22 disposed on the oil feed pipe 20A, an oil feed pipe 20B (liquid supply pipe) connected to the outlet of the header 18C of the oil cooler 17 (in other words, on the downstream side of the cooling unit 19B), and an oil filter 21B that is disposed on the oil feed pipe 20B (in other words, on the downstream side of the oil cooler 17) and that removes impurities in the oil.

The oil feed pipe 20A supplies the oil cooled by the cooling unit 19A of the oil cooler 17 to the bearings 9A to 9D and the shaft sealing units 12A to 12D of the compressor main body 2, the gears 13A and 13B, and the shaft sealing unit 14 of the motor 1. The oil feed pipe 20B supplies the oil cooled by the cooling units 19A and 19B of the oil cooler 17 to the working chambers 11A and 11B of the compressor main body 2.

The oil feed system 7 includes a bypass pipe 23A that bypasses the oil cooler 17 and that is connected to the oil feed pipe 20A, a bypass pipe 23B that bypasses the oil cooler 17 and that is connected to the oil feed pipe 20B, and a temperature regulating valve 24 that regulates a flow division ratio of the oil for the oil cooler 17 and a flow division ratio of the oil for the bypass pipes 23A and 23B according to the temperature of the oil.

The temperature regulating valve 24 is a three-way valve. The temperature regulating valve 24 changes, for example, its wax volume according to the temperature of the oil, to thereby change an opening ratio of an outlet on the oil cooler side and an opening ratio of an outlet on the bypass pipe side. As the temperature of the oil becomes higher, the flow division ratio of the oil for the oil cooler 17 is increased, and the flow division ratio of the oil for the bypass pipes 23A and 23B is decreased. Thus, the flow rate of the oil cooled by the cooling units 19A and 19B of the oil cooler 17 and discharged from the outlet of the header 18C is increased, and the flow rate of the oil in the bypass pipe 23B is decreased. As a result, the temperature of the oil to be supplied to the working chambers 11A and 11B of the compressor main body 2 is adjusted, and the temperature of the compressed air is adjusted.

In the present embodiment configured as described above, the oil cooled by the cooling unit 19A of the oil cooler 17, that is, the oil not cooled by the cooling unit 19B and thus having a relatively high temperature, is supplied to the bearings 9A to 9D and the shaft sealing units 12A to 12D of the compressor main body 2, the gears 13A and 13B, and the shaft sealing unit 14 of the motor 1 via the oil feed pipe 20A. Therefore, a mechanical loss can be reduced as compared with a case where the oil having a relatively low temperature is supplied. On the other hand, the oil cooled by the cooling units 19A and 19B of the oil cooler 17 and thus having a relatively low temperature is supplied to the working chambers 11A and 11B of the compressor main body 2 via the oil feed pipe 20B. Therefore, compression power can be reduced as compared with a case where the oil having a relatively high temperature is supplied. As described above, the mechanical loss is reduced, and the compression power is reduced, so that the shaft power of the compressor can be reduced.

Effects of the present embodiment described above will be described by using concrete numerical examples. In the conventional technology, the temperature of the oil supplied to the bearings 9A to 9D and the shaft sealing units 12A to 12D of the compressor main body 2, the gears 13A and 13B, and the shaft sealing unit 14 of the motor 1 and the temperature of the oil supplied to the working chambers 11A and 11B of the compressor main body 2 are substantially the same, and are, for example, 80° C. In the present embodiment, the temperature of the oil to be supplied to the bearings 9A to 9D and the shaft sealing units 12A to 12D of the compressor main body 2, the gears 13A and 13B, and the shaft sealing unit 14 of the motor 1 is raised to 90° C., for example, and therefore, the mechanical loss is reduced. The temperature of the oil to be supplied to the working chambers 11A and 11B of the compressor main body 2 is lowered to 70° C., for example, and therefore, the compression power is reduced. As a result, though depending on rotor specifications and the like, supposing that the shaft power of the compressor according to the conventional technology is 100%, the shaft power of the compressor according to the present embodiment can be reduced to 99.2%.

Further, in the present embodiment, the following effect can be obtained. As a comparative example, a case is assumed in which the oil feed system includes a first oil feed pipe that supplies the oil from the separator 5 to the bearings 9A to 9D and the shaft sealing units 12A to 12D of the compressor main body 2, the gears 13A and 13B, and the shaft sealing unit 14 of the motor 1, a first oil cooler that is disposed on the first oil feed pipe and that cools the oil, a second oil feed pipe that supplies the oil from the separator 5 to the working chambers 11A and 11B of the compressor main body 2, and a second oil cooler that is disposed on the second oil feed pipe and that cools the oil.

In the comparative example described above, the temperature of the oil to be supplied to the bearings 9A to 9D and the shaft sealing units 12A to 12D of the compressor main body 2, the gears 13A and 13B, and the shaft sealing unit 14 of the motor 1 and the temperature of the oil to be supplied to the working chambers 11A and 11B of the compressor main body 2 can be made different from each other. However, in the comparative example, the number of oil coolers and the number of pipes and joints for connecting the oil coolers to parts are increased, so that the compressor is increased in size. In the present embodiment, on the other hand, the number of oil coolers and the number of pipes and joints for connecting the oil coolers to parts are decreased, so that the compressor can be miniaturized. In addition, in the present embodiment, the flow rate of the oil in the cooling unit 19B of the oil cooler 17 can be decreased as compared with the flow rate of the oil in the cooling unit 19A. The oil to be supplied to the working chambers 11A and 11B of the compressor main body 2 can thus be cooled efficiently.

Figure 4:
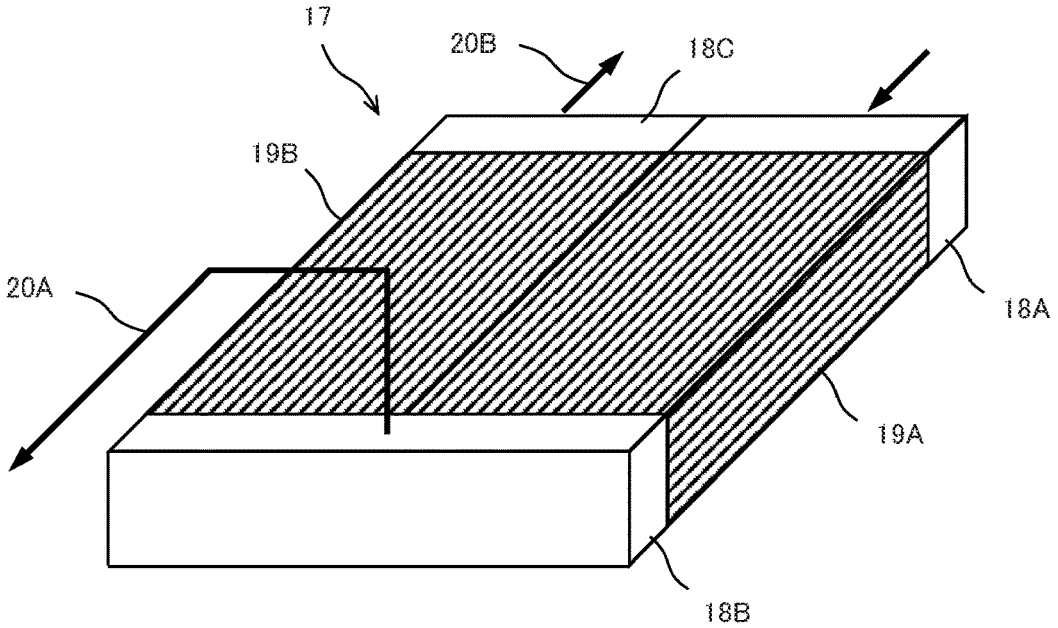
FIG. 4 is a schematic diagram illustrating a structure of an oil cooler according to a first modification of the present invention.

It is to be noted that, in the foregoing embodiment, a case where the oil cooler 17 includes the cooling unit 19A and the cooling unit 19B arranged in series as illustrated in FIG. 3 has been described by way of example. However, the oil cooler is not limited to this. As in a modification illustrated in FIG. 4, for example, the oil cooler 17 may include the cooling unit 19A and the cooling unit 19B arranged in parallel with each other.

Figure 5:
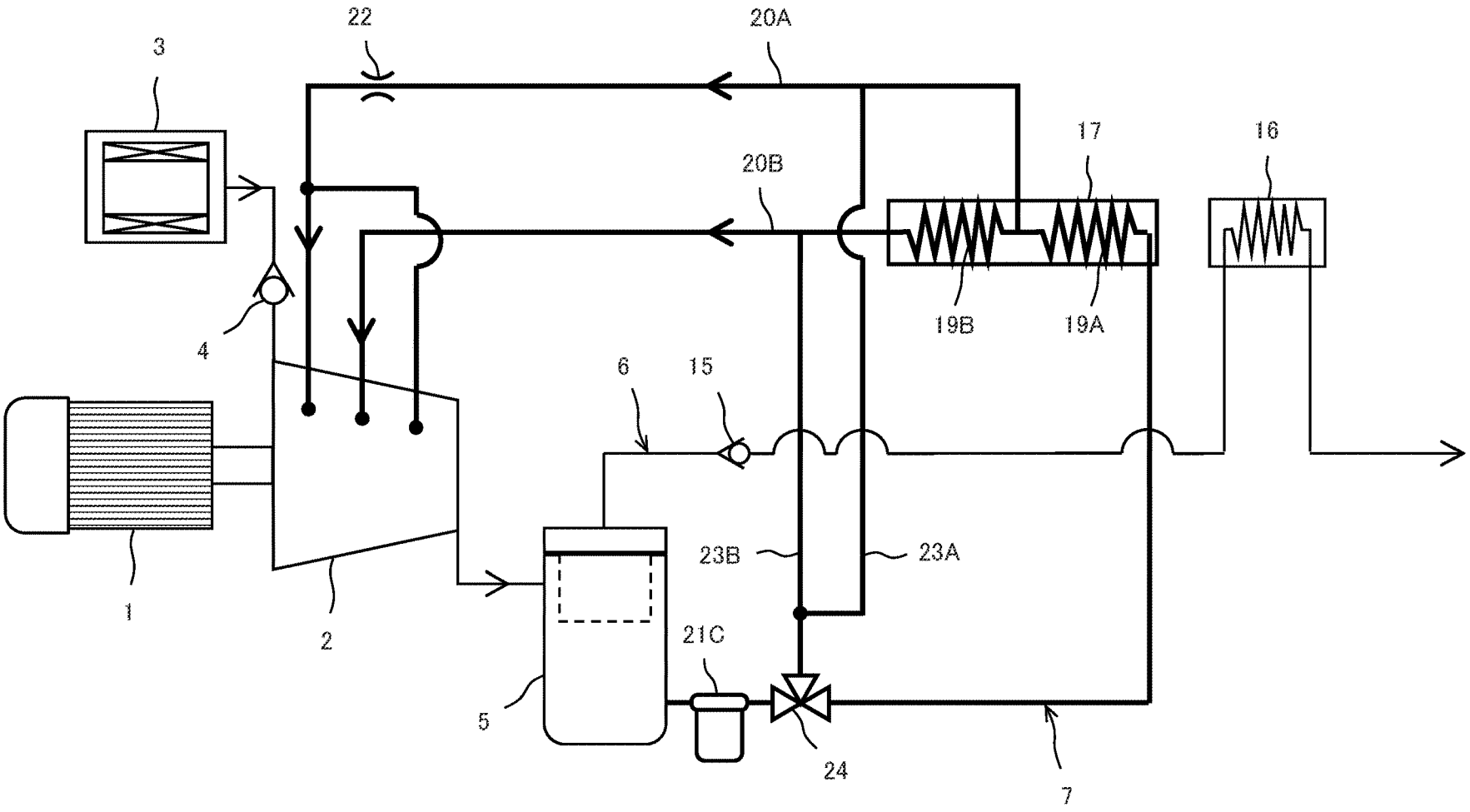
FIG. 5 is a schematic diagram illustrating a configuration of an oil feed type air compressor according to a second modification of the present invention.

In addition, in the foregoing embodiment, a case where the oil feed system 7 includes the oil filters 21A and 21B respectively arranged on the oil feed pipes 20A and 20B has been described by way of example. However, the oil feed system is not limited to this. For example, if impurities in the oil have small adverse effects on parts, the oil feed system 7 may include only one of the oil filters 21A and 21B, or may not include the oil filters 21A and 21B. Alternatively, as in a modification illustrated in FIG. 5, for example, the oil feed system 7 may include an oil filter 21C disposed on the upstream side of the temperature regulating valve 24. In this modification, by use of one oil filter, impurities can be removed from the oil to be supplied to the working chambers 11A and 11B, the bearings 9A to 9D, and the shaft sealing units 12A to 12D of the compressor main body 2, the gears 13A and 13B, and the shaft sealing unit 14 of the motor 1.

Figure 6:
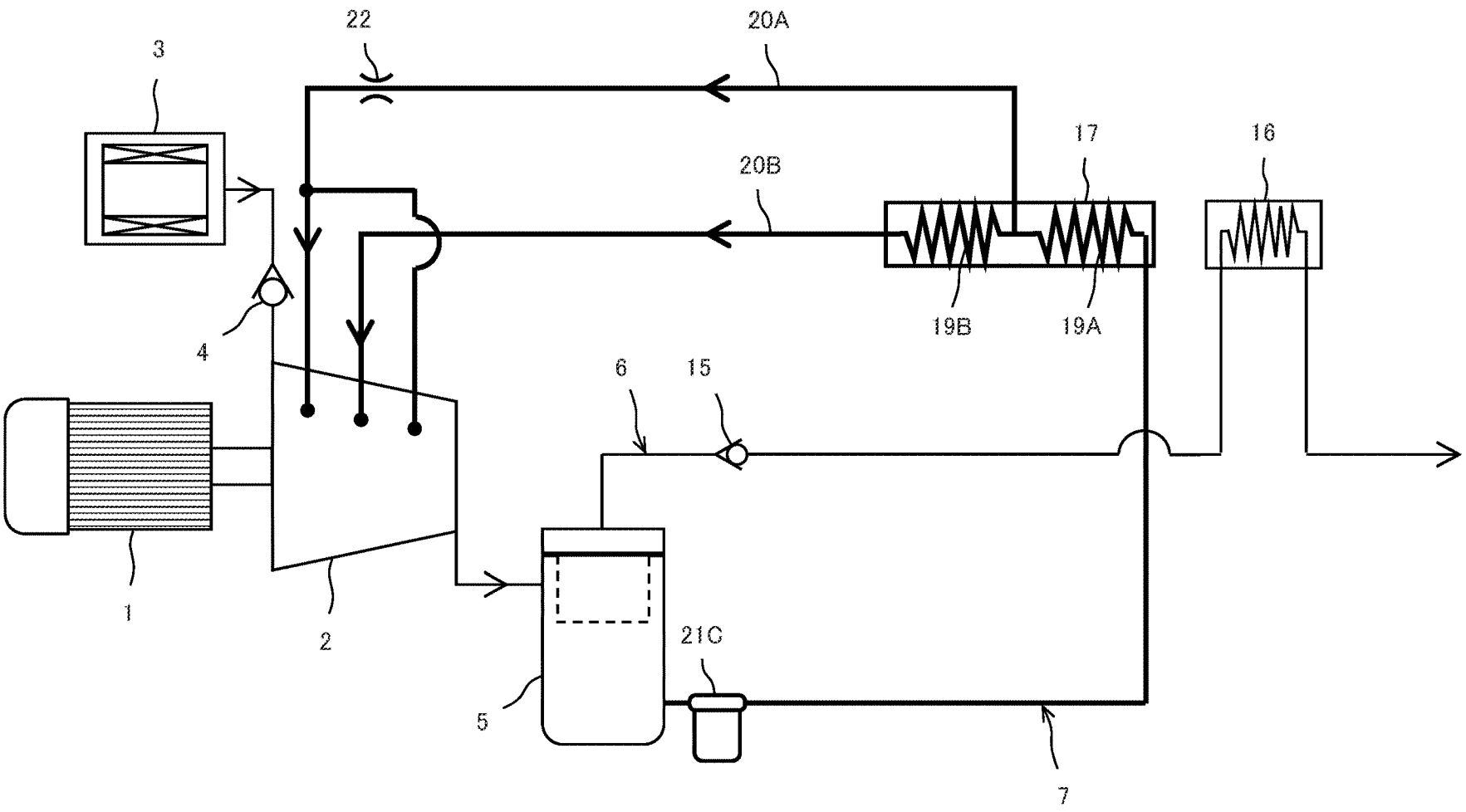
FIG. 6 is a schematic diagram illustrating a configuration of an oil feed type air compressor according to a third modification of the present invention.

In addition, in the foregoing embodiment, a case where the oil feed system 7 includes the bypass pipes 23A and 23B, which bypass the oil cooler 17, and the temperature regulating valve 24, which adjusts the flow division ratio of the oil for the oil cooler 17 and the flow division ratio of the oil for the bypass pipes 23A and 23B according to the temperature of the oil, has been described by way of example. However, the oil feed system is not limited to this. As in a modification illustrated in FIG. 6, for example, the oil feed system 7 may not include the bypass pipes 23A and 23B or the temperature regulating valve 24. Further, the cooling power of the oil cooler 17 may be varied by, for example, variably controlling the rotational speed of the cooling fans according to a temperature sensed by a temperature sensor (not illustrated) in the separator 5.

Figure 7:
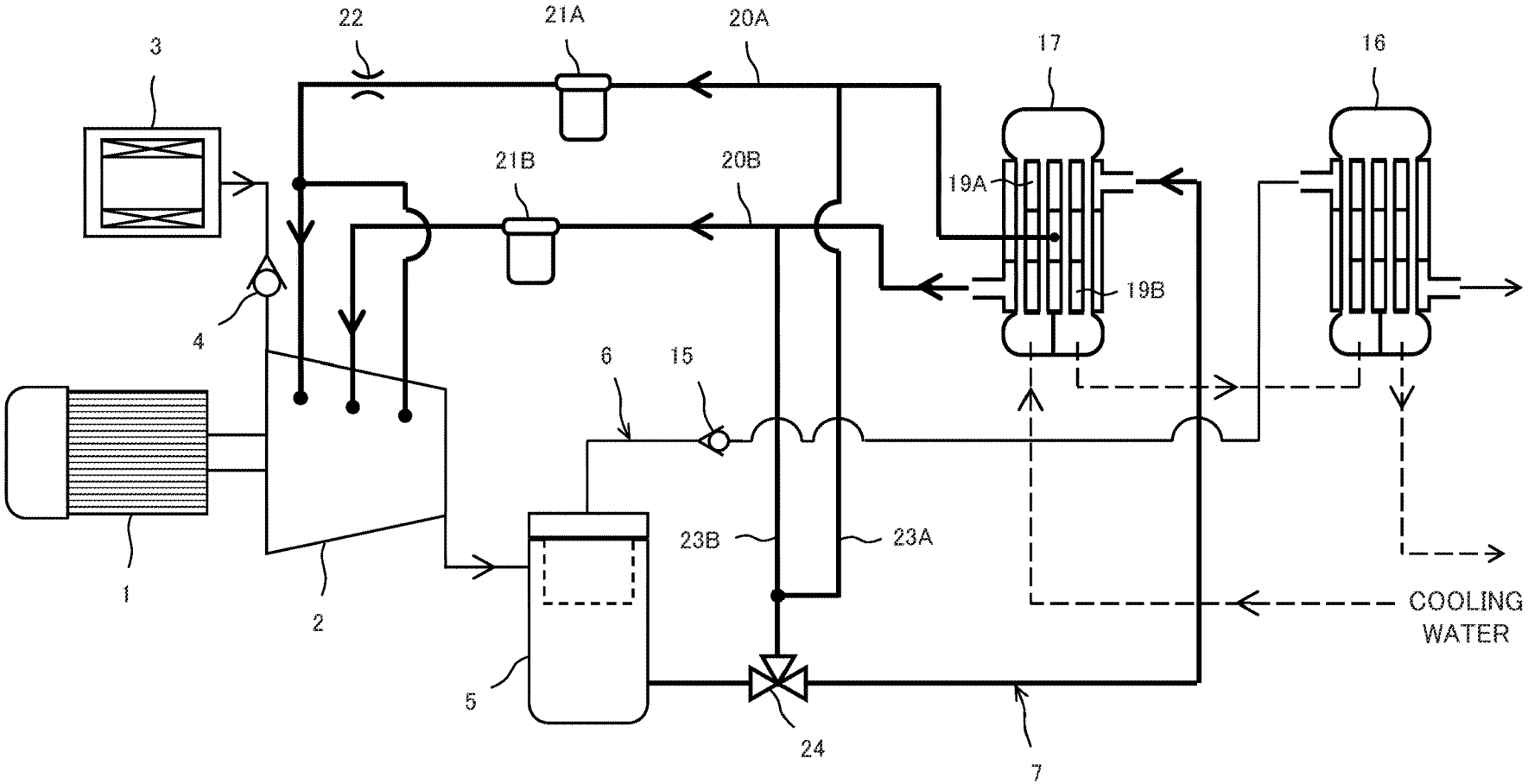
FIG. 7 is a schematic diagram illustrating a configuration of an oil feed type air compressor according to a fourth modification of the present invention.

In addition, in the foregoing embodiment, a case where the aftercooler 16 and the oil cooler 17 are of an air cooling type and cool the compressed air and the oil, respectively, by heat exchange with cooling air generated by a cooling fan has been described by way of example. However, the aftercooler and the oil cooler are not limited to them. As in a modification illustrated in FIG. 7, for example, the aftercooler 16 and the oil cooler 17 may be of a water cooling type and cool the compressed air and the oil, respectively, by heat exchange with cooling water. In the present modification, the oil cooler 17 includes, for example, the cooling unit 19A and the cooling unit 19B connected to each other in such a manner that the oil flows in that order. The cooling units 19A and 19B cool the oil by heat exchange with cooling water. An outlet from which the oil cooled by the cooling unit 19A is discharged is formed between the cooling unit 19A and the cooling unit 19B. The oil feed pipe 20A is connected to this outlet. An outlet from which the oil cooled by the cooling units 19A and 19B is discharged is formed on the downstream side of the cooling unit 19B. The oil feed pipe 20B is connected to this outlet. The present modification configured as described above can also provide similar effects to those described above.

In addition, in the foregoing embodiment, a case where the oil feed pipe 20A supplies the oil cooled by the cooling unit 19A of the oil cooler 17 to the bearings 9A to 9D and the shaft sealing units 12A to 12D of the compressor main body 2, the gears 13A and 13B, and the shaft sealing unit 14 of the motor 1 has been described by way of example. However, the oil feed pipe is not limited to this. For example, if the gears 13A and 13B and the shaft sealing unit 14 of the motor 1 are not present, the oil feed pipe 20A may supply the oil cooled by the cooling unit 19A of the oil cooler 17 to the bearings 9A to 9D and the shaft sealing units 12A to 12D of the compressor main body 2. Alternatively, for example, if the shaft sealing unit 12A of the compressor main body 2, the gears 13A and 13B, and the shaft sealing unit 14 of the motor 1 are not present, the oil feed pipe 20A may supply the oil cooled by the cooling unit 19A of the oil cooler 17 to the bearings 9A to 9D of the compressor main body 2.

In addition, in the foregoing embodiment, a case where the compressor main body 2 is of a screw type and includes the two screw rotors 8A and 8B has been described by way of example. However, the compressor main body is not limited to this. The compressor main body may include, for example, one screw rotor and a plurality of gate rotors. Alternatively, the compressor main body 2 may be of another type except the screw type.

It is to be noted that, in the above, a case where the present invention is applied to an oil feed type air compressor (that is, the compressor main body 2 compresses air while injecting oil to compression chambers) has been described by way of example. However, the present invention is not limited to this and may be applied to other liquid feed type compressors (that is, the compressor main body 2 injects other liquid except oil to the working chambers or compresses other gas except air).

DESCRIPTION OF REFERENCE CHARACTERS

1: Motor
2: Compressor main body
5: Separator
7: Oil feed system 7 (liquid supply system)
8A, 8B: Screw rotor
9A to 9D: Bearing
10: Casing
11A, 11B: Working chamber
12A to 12D: Shaft sealing unit (first shaft sealing unit)
13A, 13B: Gear
14: Shaft sealing unit (second shaft sealing unit)
17: Oil cooler (cooler)
19A, 19B: Cooling unit
20A, 20B: Oil feed pipe (liquid supply pipe)
21A to 21C: Oil filter
23A, 23B: Bypass pipe
24: Temperature regulating valve

The invention claimed is:

1. A liquid feed type gas compressor comprising:
a compressor main body that includes a rotor, bearings rotatably supporting the rotor, and a casing housing the rotor and the bearings and that compresses gas while injecting a liquid to working chambers formed between the rotor and an inner wall of the casing;
a separator that separates the liquid from compressed gas delivered from the compressor main body; and
a liquid supply system that supplies the liquid separated by the separator to the working chambers and the bearings of the compressor main body, wherein
the liquid supply system includes:
a cooler including a first cooling unit that cools the liquid and a second cooling unit that is connected to a downstream side of the first cooling unit and that cools the liquid, wherein the first cooling unit and the second cooling unit are coupled to each other via a header,
a first liquid supply pipe that is connected to an outlet in the header between the first cooling unit and the second cooling unit of the cooler and that supplies the liquid cooled by the first cooling unit of the cooler to the bearings of the compressor main body, and
a second liquid supply pipe that is connected to an outlet on a downstream side of the second cooling unit of the cooler and that supplies the liquid cooled by the first cooling unit and the second cooling unit of the cooler to the working chambers of the compressor main body.

2. The liquid feed type gas compressor according to claim 1, including:
a first shaft sealing unit disposed on an outer circumference side of a shaft portion of the rotor of the compressor main body, wherein
the first liquid supply pipe supplies the liquid cooled by the first cooling unit of the cooler to the bearings and the first shaft sealing unit of the compressor main body.

3. The liquid feed type gas compressor according to claim 2, including:
a motor that drives the compressor main body;
a plurality of gears disposed between a rotary shaft of the motor and the rotor of the compressor main body; and
a second shaft sealing unit disposed on an outer circumference side of the rotary shaft of the motor, wherein
the first liquid supply pipe supplies the liquid cooled by the first cooling unit of the cooler to the bearings and the first shaft sealing unit of the compressor main body, the plurality of gears, and the second shaft sealing unit.

4. The liquid feed type gas compressor according to claim 1, wherein
the liquid supply system includes:
a first bypass pipe that bypasses the cooler and that is connected to the first liquid supply pipe,
a second bypass pipe that bypasses the cooler and that is connected to the second liquid supply pipe,
a temperature regulating valve that regulates a flow division ratio of the liquid for the cooler and a flow division ratio of the liquid for the first and second bypass pipes according to a temperature of the liquid, and a filter disposed on an upstream side of the temperature regulating valve.

5. The liquid feed type gas compressor according to claim 1, wherein the liquid supply system includes a filter disposed on an upstream side of the cooler.

* * * * *